US005183408A

United States Patent [19]

Hatagishi

[11] Patent Number: 5,183,408

[45] Date of Patent: Feb. 2, 1993

[54] CONNECTOR WITH FITTING OPERATION CAM MEMBERS

[75] Inventor: Yuji Hatagishi, Shizuoka, Japan

[73] Assignee: Yazaki Corporation, Tokyo, Japan

[21] Appl. No.: 800,103

[22] Filed: Nov. 29, 1991

[30] Foreign Application Priority Data

Nov. 30, 1990 [JP] Japan ..... 2-329502

[51] Int. Cl.[5] ..... H01R 13/44

[52] U.S. Cl. ..... 439/147; 439/157; 439/310; 439/347; 439/596; 439/142

[58] Field of Search ..... 439/136, 142, 144, 147, 439/157, 299, 310, 338, 341-343, 347, 366, 372, 376, 596

[56] References Cited

U.S. PATENT DOCUMENTS

| | | | |
|---|---|---|---|
| 2,998,588 | 8/1961 | Chamberlain . | |
| 3,392,245 | 7/1968 | Asick . | |
| 3,750,087 | 7/1973 | Vetter . | |
| 4,332,432 | 6/1982 | Colleran . | |
| 4,537,454 | 8/1985 | Douty et al. | 439/157 |
| 4,586,771 | 5/1986 | Kraemer et al. . | |
| 4,779,950 | 10/1988 | Williams | 439/147 |
| 4,875,873 | 10/1989 | Ishizuka et al. | 439/157 |
| 4,902,240 | 2/1990 | Kuzuno et al. | 439/157 |

FOREIGN PATENT DOCUMENTS

| | | | |
|---|---|---|---|
| 3730020 | 9/1988 | Fed. Rep. of Germany | 439/347 |
| 50-15311 | 6/1975 | Japan . | |
| 52-133993 | 10/1977 | Japan . | |
| 55-13396 | 4/1980 | Japan . | |
| 0952651 | 3/1964 | United Kingdom | 439/310 |
| 1442837 | 7/1976 | United Kingdom | 439/347 |

*Primary Examiner*—Paula A. Bradley

*Attorney, Agent, or Firm*—Sughrue, Mion, Zinn, Macpeak & Seas

[57] ABSTRACT

A pair of cam members are provided for connection between male and female connector housings. Each cam member is reciprocally movable between an end wall and an intermediate portion of a hood portion of the female housing, and of a bifurcated configuration having a pair of opposed arms and a rear plate interconnecting the pair of arms, each of the arms having a drive projection. The cam members are adapted to be angularly movably attached to the hood portion, whereby when the female housing is not in use, an opening of the hood portion is closed by the rear plates of the pair of cam members which are turned generally upright.

9 Claims, 5 Drawing Sheets

CONNECTOR WITH FITTING OPERATION CAM MEMBERS

BACKGROUND OF THE INVENTION

This invention relates to an electric connector used mainly for connecting electric wiring of an automobile, and effects fitting connection and disconnection of a pair of opposed housings relative to each other by operating cam members.

U.S. Pat. No. 4,586,771 discloses a connector assembly as shown in FIG. 5. The connector assembly comprises first and second housings a and b and a camming slide c. The first and second housings a and b contains male metal terminals e and female metal terminals d, respectively.

The camming system comprises slots in the first housing a, cam tracks in the second housing b, and cam followers on the camming slide C.

The slots a2 are formed in a hood a1 of the first housing a so as to guide the camming slide c fitted on this hood a1.

Cam followers c1 are formed on opposed internal surfaces of the generally U-shaped camming slide c, and are adapted to be fitted respectively in the slots a2 to be projected into the hood a1.

The cam tracks comprises entrance portions b1 formed in opposite sidewalls of the second housing b for respectively receiving the cam followers c1 therein, and intermediate portions b2, respectively, extending from the entrance portions b1 diagonally.

In the above construction, when the first and second housings a and b are to be mated or coupled to each other, the second housing b is, first, located in alignment with the first housing a to which the camming slide c is assembled, such that the left endwalls of the second housing abuts locating surfaces of the camming slide and first housing, as shown in FIG. 6A. The second housing b is, then, moved inwardly from the position of FIG. 6A so that the cam followers c1, respectively, enter the entrance portions b1 as shown in FIG. 6B. After that, the camming slide c is moved to the position of FIG. 6C. During such movement of the camming slide c, the cam followers c1 will move relatively through the intermediate portions b2 and move the second housing b into coupled relationship with the first housing a.

In the above conventional art, the cam followers c1 of the camming slider c are fitted in the respective intermediate portions b2 of the cam tracks through the respective slots a2, thereby fitting the second housing b into the first housing a with a small force. This construction is used for a multipolar connector having many metal terminals d and e.

However, with an increased number of poles, the opening of the hood a1 is increased in size, and pin-like distal end portions e1 of the male metal terminals e projected into this opening remain exposed. Therefore, there is a risk that during the assembling operation, the pin-like portion el may strike against a projecting object f, such as a tool, to be deformed.

Further, if the cam followers c1 are remote from a force applying point c2 of the camming slider c, the force can not sufficiently be transmitted, and as a result the camming slider c is deformed, and also the degree of interconnection of many metal terminals d and e becomes uneven, thus posing another problem that it is difficult to smoothly fit the first and second housings a and b together.

SUMMARY OF THE INVENTION

With the above problems in view, it is an object of this invention to provide a construction which enables a smooth fitting operation of a multipolar connector, and suitably protects male metal terminals of a female housing.

The above object has been achieved by a connector with fitting operation cam members, comprising a female housing on which fitting operation cam means having drive projections is slidably mounted through sliding guide slots formed in a hood portion of the female housing; and a male housing having slanting driven grooves which are formed in an outer surface thereof so as to respectively receive the driven projections, wherein fitting connection and disconnection of the female and male housings relative to each other are carried out by moving the fitting operation cam means.

The cam means comprises a pair of cam members each reciprocally movable between an end wall and an intermediate portion of said hood portion; each of the pair of cam members is of a bifurcated configuration having a pair of opposed arms and a rear plate interconnecting the pair of arms, each of the arms having the drive projection; and the cam members are angularly movably attached to the hood portion, whereby when the female housing is not in use, an opening of the hood portion is closed by the rear plates of the pair of cam members by turning the pair of cam members generally upright.

In the present invention, the fitting connection and disconnection of the female and male housings relative to each other are carried out by the pair of right and left cam members, and therefore the force can be transmitted uniformly, and these operations can be carried out smoothly even with a multipolar construction.

Further, when the female housing is not in use, the pair of cam members turned upright so as to close the opening of the hood portion by the rear plates of the cam members. Therefore, metal terminals within the female housing can be protected from damage.

DESCRIPTION OF THE PREFERRED EMBODIMENT

Figure 1:
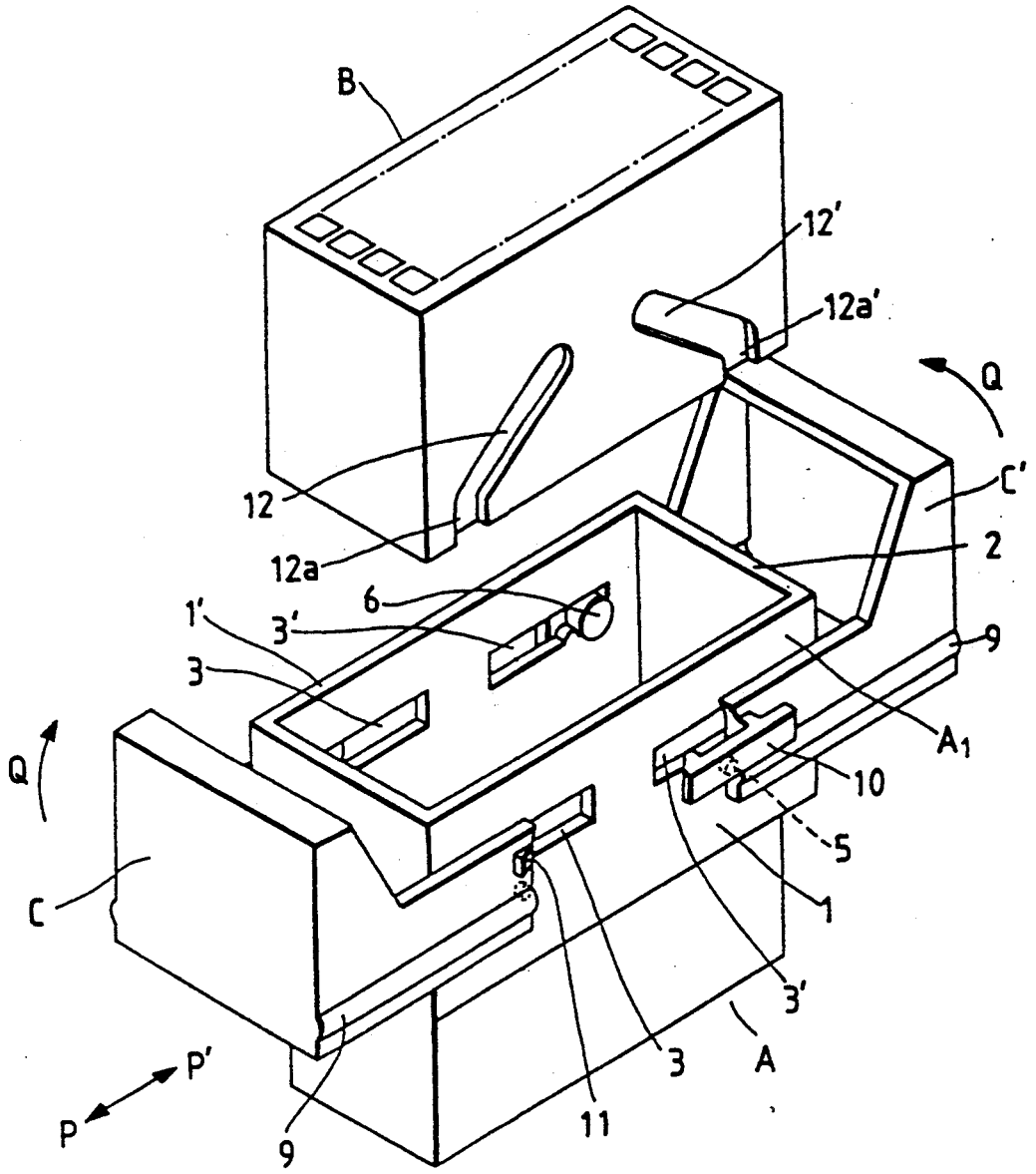
FIG. 1 is a perspective view of one preferred embodiment of the present invention, showing female and male housings as being separated from each other.
Figure 2:
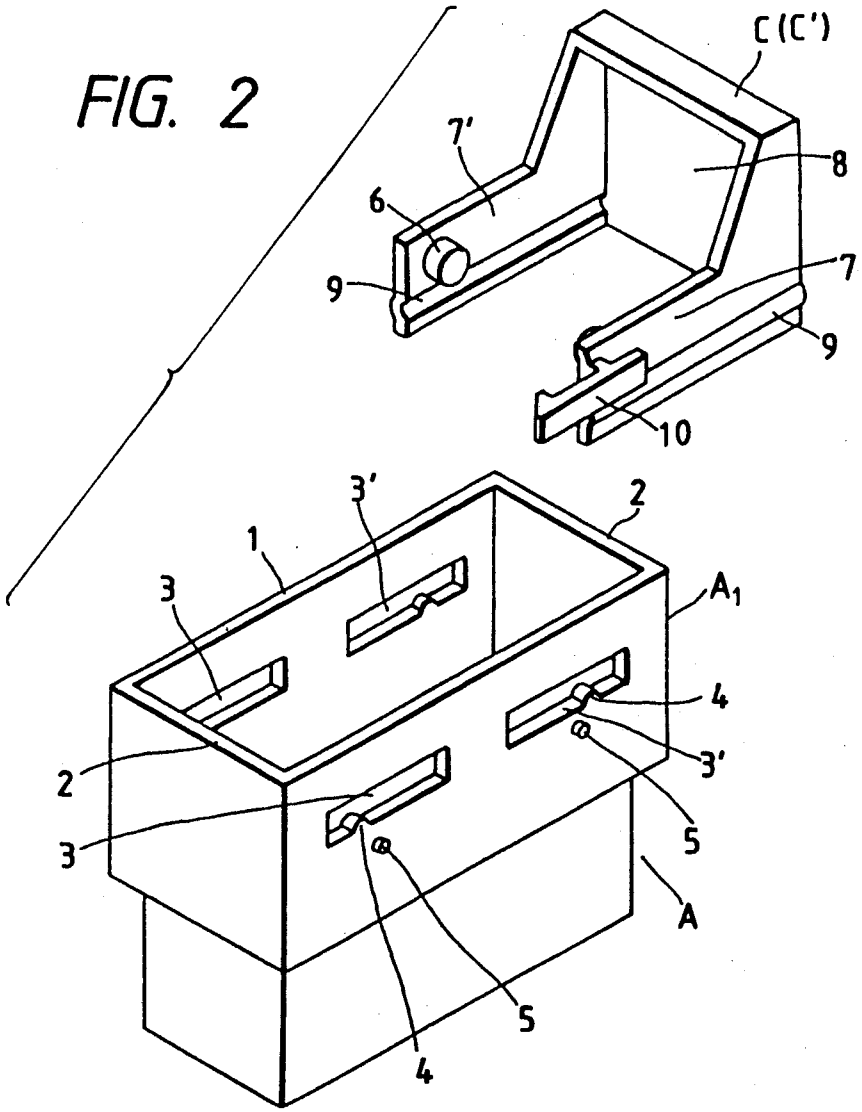
FIG. 2 is a perspective view showing the male housing and a fitting operation cam member as being separated from each other.

In FIGS. 1 and 2, reference character A denotes a female housing, reference character B a male housing, reference characters C and C' a pair of right and left fitting operation cam members. Metal terminals (not shown) are received in each of the pair of female and male housings A and B constituting a connector.

A hood portion A1 of the female housing A is of a frame-like configuration constituted by opposed longitudinal side walls 1 and 1' and opposite end walls 2 and 2. A pair of left and right sliding guide slots 3 and 3' for respectively guiding the cam members C and C' are formed through each of the opposed side walls 1 and 1', these slots extending in a direction perpendicular to the direction of fitting. A provisionally-retaining projection 4 is formed on the edge of each of the slots 3 and 3' at a position close to the end wall 2. Latch projections 5 are formed on the opposed side walls 1 and 1', and are disposed below the sliding guide slots 3 and 3', respectively.

The fitting operation cam members C and C' are of the similar construction, that is, of a bifurcated construction. Each cam member includes a pair of opposed arms 7 and 7' each having a drive projection 6 at its inner surface, and a rear plate 8 interconnecting the two arms. A relief groove 9 for the latch projection 5 is formed in each of the arms 7 and 7', and extends parallel to the sliding direction. A flexible lock piece 10 is provided on the distal end of one arm 7, and a retainer 11 for engagement with the lock piece 10 is provided on the distal end of the other arm 7'.

Introduction grooves 12*a* and 12*a*' for respectively receiving the drive projections 6 of the cam members C and C', as well as slanting driven grooves 12 and 12' extending respectively from the introduction grooves 12*a* and 12*a*' and inclined toward each other, are formed in each of the opposite outer surfaces of the male housing B.

In the above construction, as shown in FIG. 1, the pair of left and right fitting operation cam members C and C' are slidably mounted on the female connector housing, with their drive projections 6 projected into the hood portion A1 through the respective sliding guide slots 3 and 3'. The cam members are reciprocally movable along the slots 3 and 3', respectively, as indicated by arrows P and P'.

When the fitting operation cam members C and C' are disposed respectively at the left and right ends of the hood portion A1, that is, spaced from each other most remotely, each of the cam members C and C' is provisionally retained by the provisionally-retaining projections 4 in the sliding guide slots 3, 3', so that the two cam members are prevented from moving toward each other. In this condition, each cam member can be angularly moved about the drive projections 6, engaged in the slots 3, 3', as indicated by arrow Q.

Figure 3:
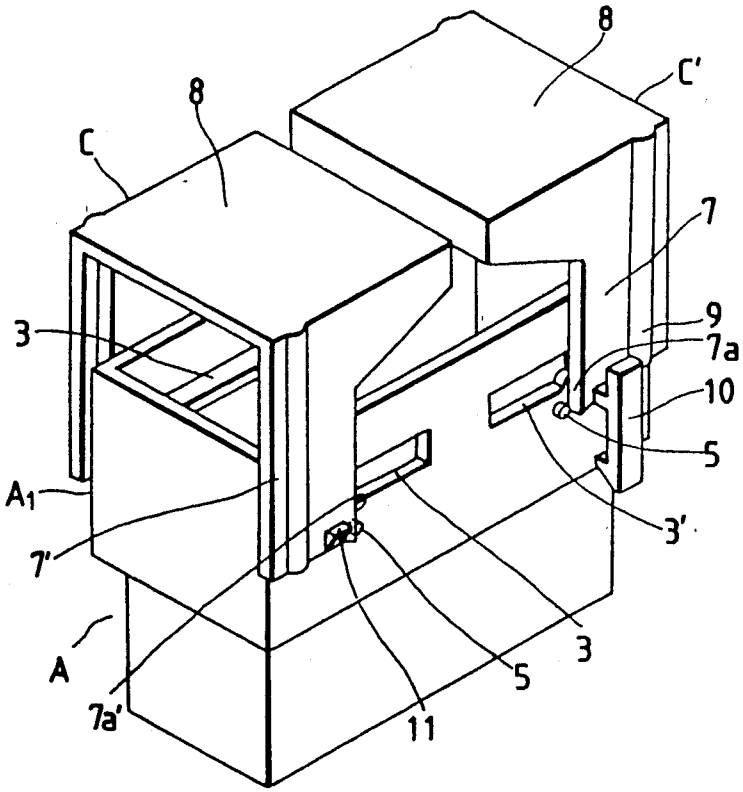
FIG. 3 is a perspective view showing the male housing of FIG. 1 as being closed by a pair of cam members.

Therefore, when the female housing A is not used, the pair of fitting operation cam members C and C' are turned upright as shown in FIG. 3, so that the opening of the hood portion A1 is closed by the rear plates 8 and 8 of the members C and C'. In this case, end edges 7*a* and 7*a*' of the arms 7 and 7' of each of the cam members C and C' are engaged respectively with the latch projections 5, thereby preventing each cam member from falling due to its own weight. Therefore, the closing by the rear plates 8 and 8 is maintained.

Figure 5:
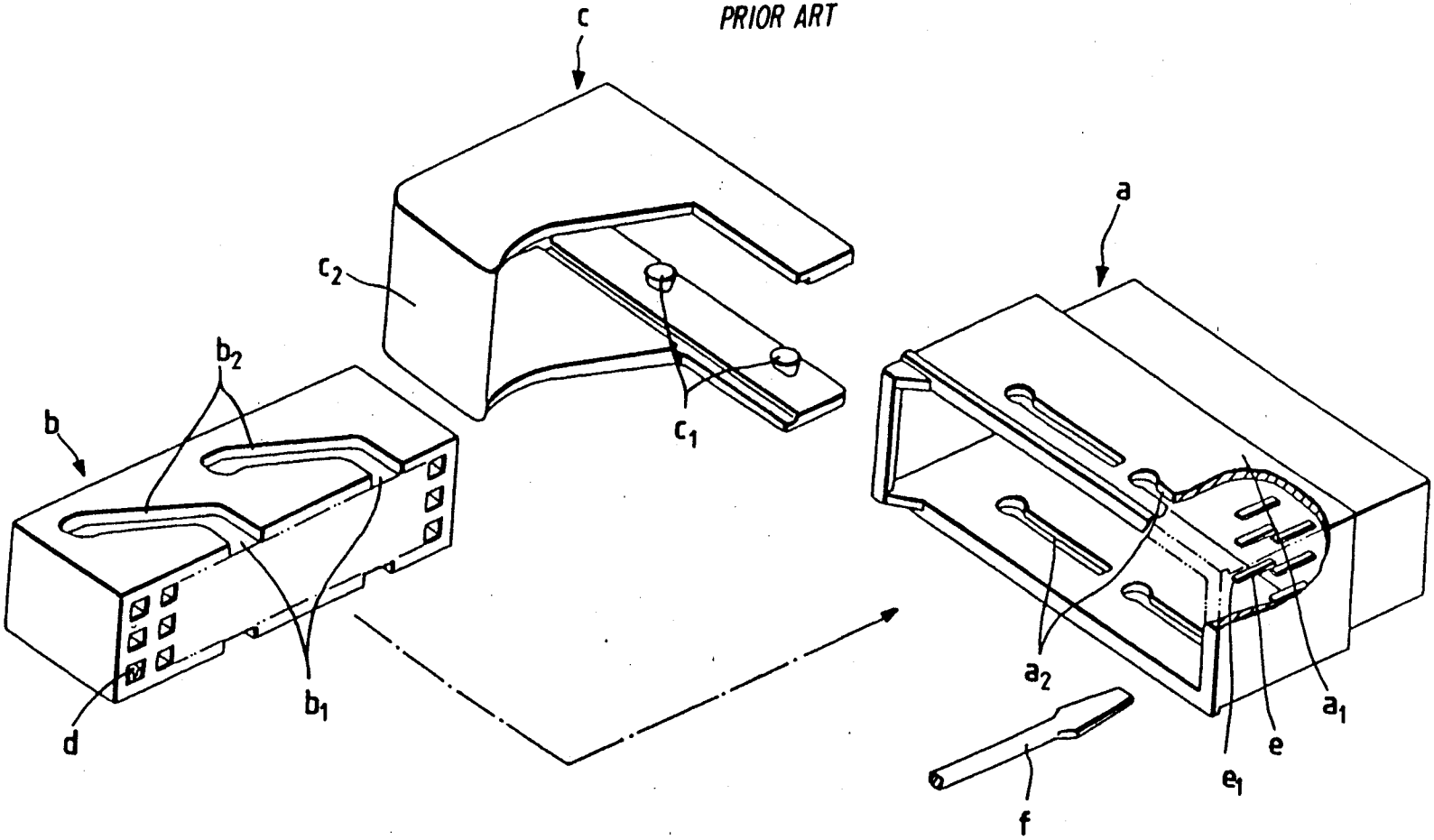
FIG. 5 PRIOR ART
FIG. 5 is a partly-broken, exploded perspective view of the conventional art.
Figure 6A:
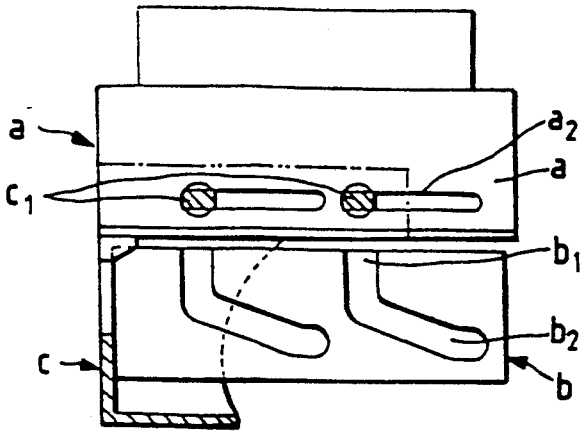
FIG. 6A PRIOR ART
FIGS. 6A to 6C are partly-broken plan views showing a fitting process of the above conventional art.
Figure 6B:
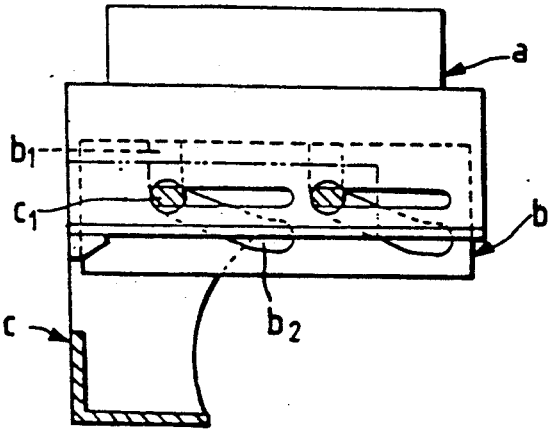
FIG. 6B PRIOR ART
Figure 6C:
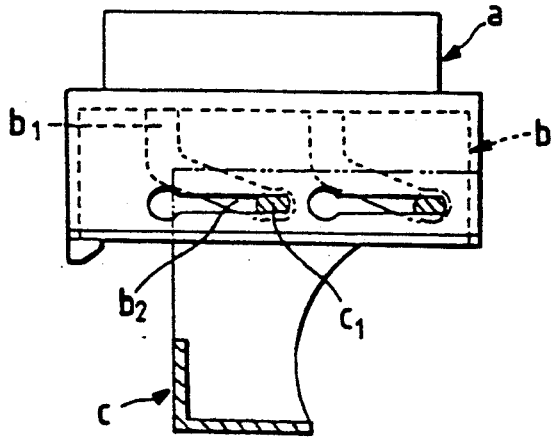
FIG. 6C PRIOR ART

Therefore, in contrast with the conventional art shown in FIG. 5, there is no risk that a projecting object will intrude into the hood portion A1 to damage the metal terminal.

Figure 4B:
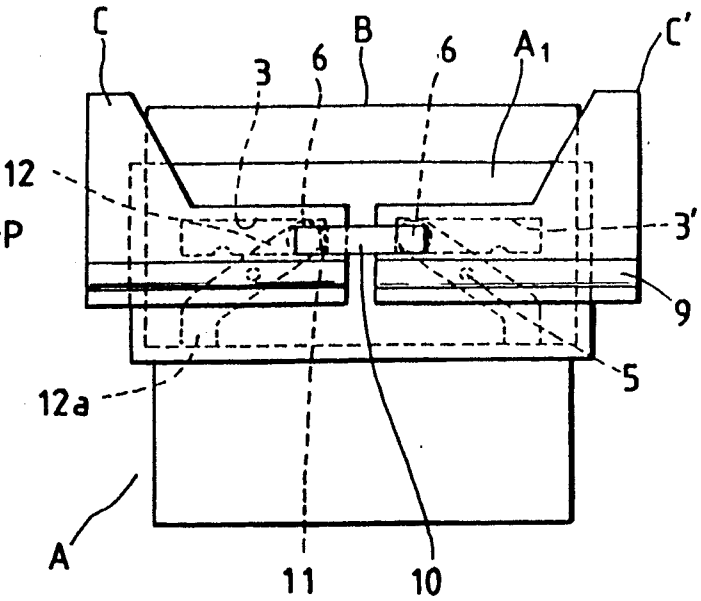
FIGS. 4A and 4B are partly-broken, plan views showing a process of fitting of the female and male housings relative to each other.
Figure 4A:
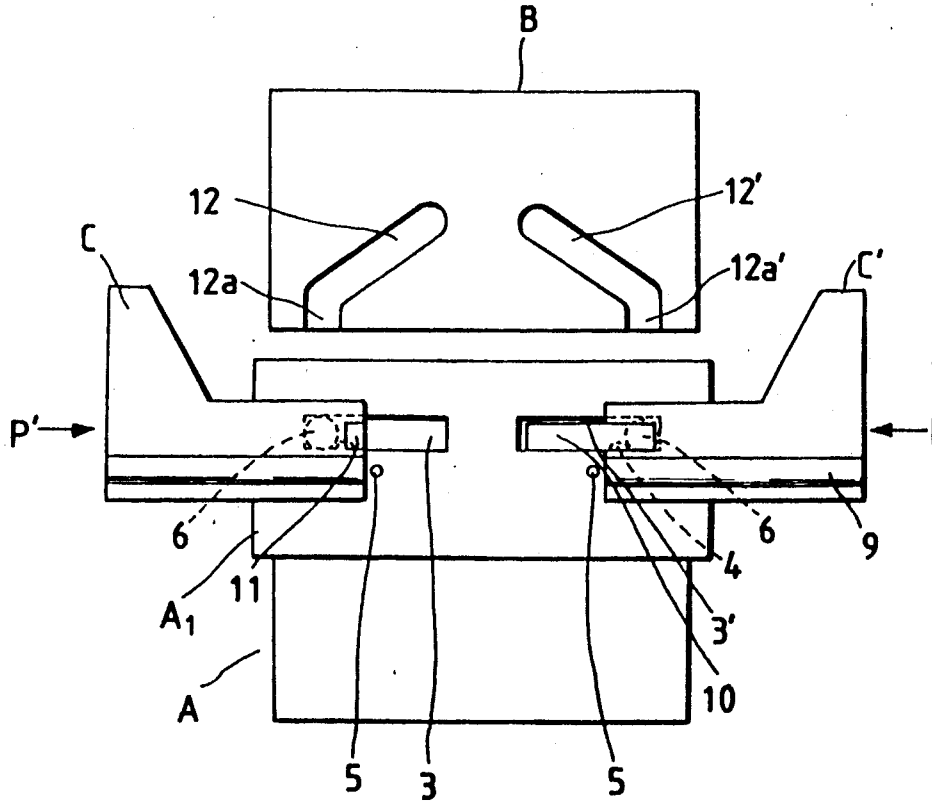

The fitting of the female and male housings A and B relative to each other is carried out according to a procedure shown in FIGS. 4A and 4B.

In FIG. 4A, the pair of left and right fitting operation cam members C and C' are spaced most remotely from each other, that is, disposed respectively at the left and right ends of the hood portion A1, as in FIG. 1.

In this condition, the male housing B is opposed to the female housing A, and the introduction grooves 12*a* and 12*a*' are brought into conformity with the drive projections 6 of the cam members C and C', respectively, and the male housing B is urged into the hood portion A1, so that the drive projections 6 are positioned at the inlets of the slanting driven grooves 12 and 12', respectively.

In this condition, the pair of cam members C and C' are moved respectively in the directions of arrows P' and P, that is, toward each other, so that the drive projections 6 drive the male housing B into the hood portion A1 through the slanting driven grooves 12 and 12'. Therefore, simultaneously with the fitting connection between the two housings, the metal terminals of the two housings are connected together.

In the completely-fitted condition, the flexible lock piece 10 of the arm 7 of one of the pair of cam members C and C' is engaged with the retainer 11 of the arm 7' of the other cam member, so that the two cam members are locked. Therefore, the complete fitting between the female and male housings A and B is maintained.

When the male housing B is to be fitted into the female housing A, the two cam members C and C' are urged toward each other, for example, by both hands so as to apply uniform forces to the cam members C and C', so that these forces are properly transmitted to the drive projections 6 of the two cam members, and therefore the fitting can be carried out smoothly. The disconnection of the male housing B from the female housing A can be carried out according to a procedure reverse to the above-mentioned procedure.

As described above, in the present invention, the female and male housings are fitted together, using the pair of right and left cam members, and therefore the fitting can be carried out even with a multipolar construction.

Further, when the female housing is not in use, the pair of cam members are turned upright so as to serve as cover means for the hood portion, and therefore the metal terminals within the female housing are protected from damage.

What is claimed is:

1. A connector with fitting operation cam members, comprising:

a female housing having sliding guide slots formed in a hood portion thereof;

fitting operation cam means having drive projections, slidably mounted onto said female housing through said sliding guide slots; and a male housing having slanting driven grooves which are formed in an outer surface thereof so as to respectively receive said driven projections, wherein fitting connection and disconnection of said female and male housings relative to each other are carried out by moving said fitting operation cam means;

said cam means comprising:

a pair of cam members each reciprocally movable between an end wall and an intermediate portion of said hood portion; each of said pair of cam members being of a bifurcated configuration having a pair of opposed arms and a rear plate interconnecting said pair of arms, each of said arms having said drive projection; and said cam members being angularly movably attached to said hood portion, whereby when said female housing is not in use, an opening of said hood portion is closed by said rear plates of said pair of cam members by turning said pair of cam members generally upright.

2. The connector with fitting operation cam members according to claim 1, wherein said cam means further comprises a flexible lock piece provided on one of said opposed arms of each of said pair of cam members, and a retainer provided on the other arm, wherein when said female and male housings are fitted together, said pair of cam members are locked by engagement of each of said flexible lock pieces with a respective one of said retainers.

3. In a connector of the type including a first housing with at least one terminal therein, and a second housing receivable within the first housing with at least one terminal mounted therein adapted to mate with the terminal of the first housing, said housings being relatively movable in a first direction with respect to one another between an initial position wherein the second housing is initially received in said first housing and an inserted position where the second housing is fully inserted within the first housing so that the terminals of the respective housings are in mating engagement, actuating means associated with said housings comprising:

sliding guide slots formed in said first housing adjacent to a mating open end thereof and extending in a second direction generally perpendicular to said first direction;

slanting cam follower grooves formed in an outer surface of said second housing and inclined with respect to said first and second direction; and a pair of actuator members mounted onto said first housing and reciprocally movable toward and away from each other through said sliding guide slots, each of said pair of actuator members having cams, each of said cams being received within corresponding one of said sliding guide slots and movable between first and second positions, each of said cams in said first position being receivable within corresponding one of said slanting cam follower grooves when said housings are in said initial position, and said connector housings being moved to be in said inserted position when each of said cams, received within said corresponding one of said slanting cam follower grooves, is moved from said first position to said second position through said pair of actuator members to be moved toward each other.

4. The connector according to claim 3, further comprising: means for locking said housings in said inserted position.

5. The connector according to claim 3, wherein said locking means includes a flexible lock piece provided on at least one of said pair of actuator members, and a retainer provided on at least the other.

6. The connector according to claim 3 wherein each of said pair of actuator members is of a bifurcated configuration having a pair of opposed arms and a rear plate interconnecting said pair of arms, each of said arms having corresponding one of said cams.

7. The connector according to claim 6, further comprising: means for preventing a rotational movement of each of said pair of actuator members during a liner movement of each of said cams with corresponding one of said sliding guide slots between said first and second positions.

8. The connector according to claim 6, wherein said actuating means further comprising: means for temporally retaining each of said cams in said first position and for allowing each of said pair of actuator members to be rotated about said cams thereof to close said mating open end of said first housing with said rear plate of each actuator member.

9. The connector according to claim 8, wherein said actuating means further comprising: means for keeping positions of said actuator members rotated to close said mating open end.

* * * * *